US006517424B2

(12) United States Patent
Wielonski et al.

(10) Patent No.: US 6,517,424 B2
(45) Date of Patent: Feb. 11, 2003

(54) PROTECTIVE COATINGS FOR CMP CONDITIONING DISK

(75) Inventors: Roy F. Wielonski, Worthington, OH (US); Mohamed F. El-Shazly, Dublin, OH (US)

(73) Assignee: Abrasive Technology, Inc., Lewis Center, OH (US)

( * ) Notice: Subject to any disclaimer, the term of this patent is extended or adjusted under 35 U.S.C. 154(b) by 0 days.

(21) Appl. No.: 09/790,461

(22) Filed: Feb. 22, 2001

(65) Prior Publication Data

US 2001/0046835 A1 Nov. 29, 2001

Related U.S. Application Data

(60) Provisional application No. 60/188,443, filed on Mar. 10, 2000.

(51) Int. Cl.[7] ..... B24B 53/00

(52) U.S. Cl. ..... 451/443; 451/548; 51/295

(58) Field of Search ..... 451/443, 444, 451/29, 56, 72, 548; 51/295

(56) References Cited

U.S. PATENT DOCUMENTS

| | | | | |
|---|---|---|---|---|
| 3,894,673 A | * | 7/1975 | Lowder et al. | 228/122 |
| 4,018,576 A | * | 4/1977 | Lowder et al. | 51/309 |
| 4,805,348 A | | 2/1989 | Arai et al. | |
| 5,099,614 A | | 3/1992 | Arai et al. | |
| 5,329,732 A | | 7/1994 | Karlsrud et al. | |
| 5,376,444 A | * | 12/1994 | Grotepass et al. | 428/336 |
| 5,486,131 A | * | 1/1996 | Cesna et al. | 451/56 |
| 5,498,196 A | | 3/1996 | Karlsrud et al. | |
| 5,498,199 A | | 3/1996 | Karlsrud et al. | |
| 5,543,210 A | * | 8/1996 | Kullander et al. | 428/217 |
| 5,569,062 A | * | 10/1996 | Karlsrud | 451/285 |
| 5,842,912 A | | 12/1998 | Holzapfel et al. | |
| 6,054,183 A | * | 4/2000 | Zimmer et al. | 427/249.8 |
| 6,347,982 B1 | * | 2/2002 | Holzapfel | 451/56 |
| 6,368,198 B1 | * | 4/2002 | Sung et al. | 451/443 |

FOREIGN PATENT DOCUMENTS

| | | |
|---|---|---|
| JP | 1177536 | 3/1999 |

* cited by examiner

*Primary Examiner*—Robert A. Rose
(74) *Attorney, Agent, or Firm*—Francis T. Kremblas, Jr.

(57) ABSTRACT

A conditioning element for trueing and dressing a polishing pad used in a chemical mechanical polishing process (CMP) in connection with the manufacture of semi-conductors is provided with a relatively thin protective coating comprising a material resistant to corrosive attack by CMP slurry compositions, including those particularly well-suited to resist the harsher highly acidic slurry compositions. The CMP conditioning disk comprises a substrate having a surface carrying a monolayer of superabrasive particles braze bonded to the disk and a relatively thin liquid impermeable protective coating which is applied over the surface of the braze bond material and abrasive particles. For use in highly corrosive slurry compositions such as ferric nitrate, CMP braze bonded disk carrying coatings applied by vapor deposition methods comprising chromium and multilayered coatings comprising layers of chromium and amorphous diamond or chromium nitride, for example, are particularly effective to preserve the bond strength of the braze bond material holding the abrasive particles on the CMP conditioning disks.

2 Claims, 2 Drawing Sheets

PROTECTIVE COATINGS FOR CMP CONDITIONING DISK

CROSS-REFERENCES TO RELATED APPLICATIONS

This application claims the benefit of U.S. Provisional Application No. 60/188,443 filed Mar. 10, 2000.

BACKGROUND OF THE INVENTION

1. Field of the Invention

The present invention relates generally to methods and apparatus related to the polishing of workpieces, such as semi-conductor wafers, and particularly to an improved pad or disk for conditioning and restoring polishing pads used in such methods.

2. Description of the Related Art

The production of integrated circuits involves the manufacture of high quality semiconductor wafers. As well known in this industry, a high precision, flat or planar surface is required on at least one side of the wafer to assure appropriate performance objectives are attained. As the size of the circuit components decrease and the complexity of the microstructures involve increase, the requirement for high precision surface qualities of the wafer increases.

In order to meet this need, the polishing pads typically used in the industry require re-conditioning to restore their original configuration after a period of use so that the pad may continue to be used to provide the desired surface on the wafers. The chemical mechanical planarization or polishing processes and apparatus used are well known. Reference to prior Holzapfel et al U.S. Pat. No. 4,805,348 issued February, 1989; Arai et al U.S. Pat. No. 5,099,614 issued March, 1992; Karlsrud et al U.S. Pat. No. 5,329,732 issued July, 1994; Karlsrud et al U.S. Pat. No. 5,498,196 issued March, 1996; Karlsrud et al U.S. Pat. No. 5,498,199 issued March, 1996; Cesna et al U.S. Pat. No. 5,486,131 issued January, 1996 and Holzapfel et al U.S. Pat. No. 5,842,912 issued Dec. 1, 1998 provide a broad discussion of chemical mechanical planarization referred to herein and in the industry as CMP processes.

During the polishing or planarization process of the semiconductor wafers, the polishing pad is rotated against the wafer in the presence of an abrasive slurry. The polishing pad generally used comprises a blown polyurethane-based material such as the IC and GS series of pads available from Rodel Products Corporation located in Scottsdale, Ariz. The hardness and density of the polishing pads depends upon the material of the workpiece (semiconductor wafer) that is to be polished.

During the CMP process, the chemical components of the abrasive slurry used tend to react with one or more particular materials on the wafer being polished and aid the abrasive in the slurry to remove portions of this material from the surface. During continued use of the polishing pad in this process, the rate of material removal from the wafer gradually decreases due to what is referred to in this field as "pad glazing". Additionally, with continued use, the surface of the polishing pad likely experiences uneven wear which results in undesirable surface irregularities. Therefore it is considered necessary to condition (true and dress) the polishing pad to restore it to a desirable operating condition by exposing the pad to a pad conditioning disk having suitable cutting elements. This truing and dressing of the pad may be accomplished during the wafer polishing process (in-situ conditioning) such as described in U.S. Pat. No. 5,569,062 issued on Oct. 29, 1996 to Karlsrud. However, such conditioning may also be done between polishing steps (ex-situ conditioning) such as described in U.S. Pat. No. 5,486,131 issued on Jan. 23, 1996 to Cesna et al., both of these patents being incorporated by reference herein.

Appropriate conditioning of the polishing pad is essential to restore the appropriate frictional coefficient of the pad surface and to allow effective transport of the polishing slurry to the wafer surfaces in order to obtain the most effective and precise planarization of the semiconductor wafer surface being polished.

The pad conditioner typically employed comprises a stainless steel disk coated with a monolayer of abrasive particles. Typically diamond particles or cubic boron nitride parties are preferred. These superabrasive particles may be secured to the conditioning disk by electroplating or by a brazing process. The braze bond has become more preferred due to forming a stronger bond between the diamond particles and substrate such that the diamond particles are less likely to loosen and fall free compared to electroplated or resin bonded conditioning disks. If such loose abrasive particles become embedded in the polishing pad or otherwise exposed to the wafer being polished, serious deformations in the wafer surface may occur such that the wafer becomes unusable and represent a loss of many thousand of dollars of time and labor.

Conditioning disks employing a monolayer of braze bonded diamonds such as manufactured by Abrasive Technology, Inc. of Lewis Center, Ohio, have been recognized as very effective and an improvement over prior art conditioning disks using other bonding mediums, particularly in resisting premature loss of diamond abrasive particles. However, the corrosive nature of the polishing slurries currently used and the nature of even more aggressively corrosive slurry compositions which may be deemed more desirable for the CMP processes, present a problem which tends to shorten the useful life of even such braze bonded conditioning disks. Prior to the present invention, this problem has not been fully appreciated or solved by those of ordinary skill in the art.

SUMMARY OF THE INVENTION

The present invention provides a polishing pad conditioner and method of making the same which improves the CMP process involved in planarizing semiconductor wafer surfaces by extending the useful life of the pad conditioner even in the environment of the more harsh corrosive polishing slurries presently used or contemplated for use.

In accordance with one aspect of the present invention, a polishing pad conditioning disk comprising a monolayer of super abrasive particles, preferably diamond, is braze bonded to the disk. A thin coating is applied over the braze bond such that the braze bond is protected from corrosive attack by the chemical composition of the abrasive slurry used in a CMP process so as to significantly extend the life of the conditioning disk and tend to reduce the undesirable premature loosening and fall out of the superabrasive particles bonded on the disk.

As another aspect of the present invention, the protective coating may be selected based upon the composition of the CMP abrasive slurry used so that resistance to corrosive attack may be optimized.

As a further aspect of the present invention, the protective coating may be applied in a manner which preserves the contour of the braze bonded diamond monolayer so as to restore the cutting properties of the conditioning disk as originally designed for a given CMP process requirement.

As yet another aspect of the present invention, preferred coatings to protect the braze bond and lengthen the useful effectiveness of the pad conditioning disk may be one selected from titanium nitride, chromium, amorphous diamond and layer combinations thereof. Further, certain organic coatings such as Teflon® polymeric materials, for example, may also be applied.

As yet a further aspect of the present invention, the protective coatings may be applied using generally conventional processes modified to the particular application required for the present invention, including for example, electroless or electroplating, vapor deposition, powder heat fusion processes and magnetron sputtering processes.

DESCRIPTION OF THE PREFERRED EMBODIMENT

Figure 1:
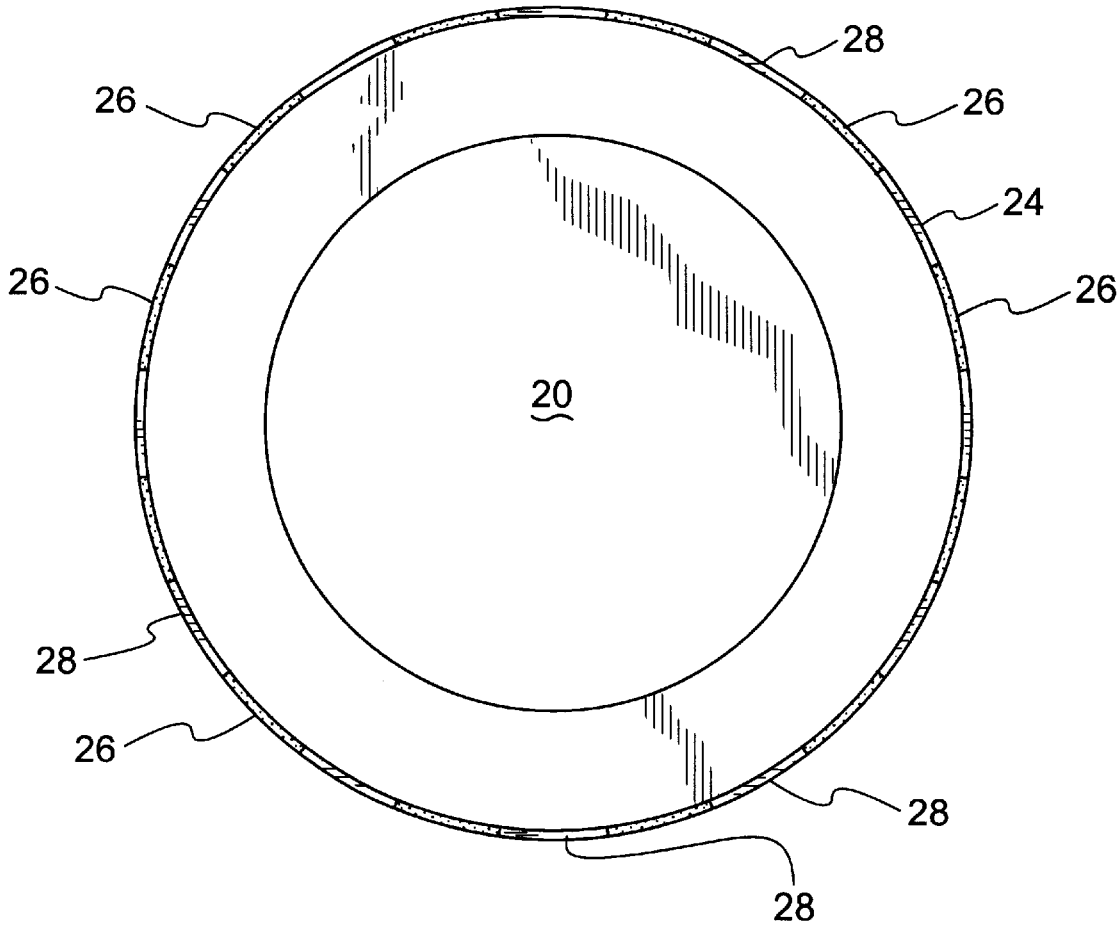
FIG. 1 is a top plan view of a typical in-situ style of a pad conditioning disk made in accordance with the present invention.
Figure 2:
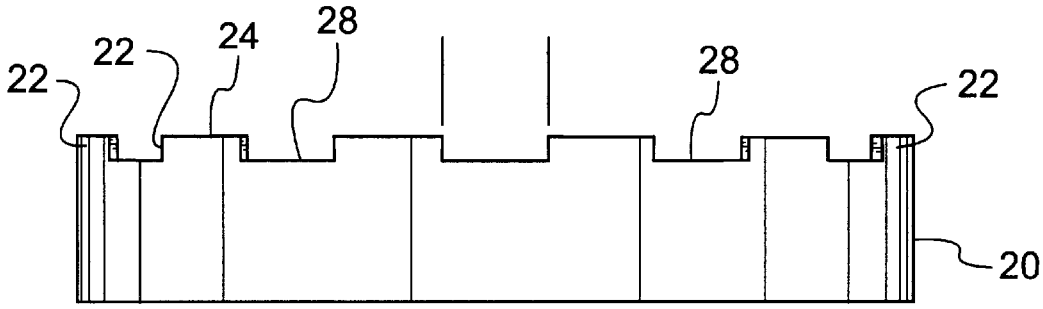
FIG. 2 is a side elevational view of the disk shown in FIG. 1.
Figure 3:
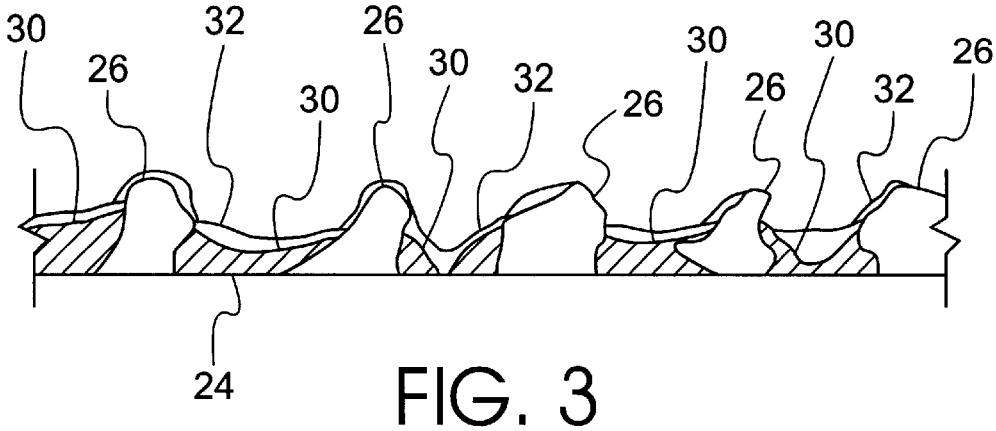
FIG. 3 is a diagrammatic view illustrating a braze bonded monolayer of superabrasive particles provided with a protective coating in accordance with the present invention which may comprise the cutting elements of the disk shown in FIG. 1.

With reference to FIGS. 1–3, a CMP polishing conditioning disk having a configuration useful for an in-situ application is shown which includes a stainless steel disk substrate 20 which includes a depending flange 22. The bottom edge 24 of flange 22 is provided with a monolayer of diamond abrasive particles 26 braze bonded to a substantially planar edge surface 24 using a braze bonding process such as generally described in Lowder et al U.S. Pat. Nos. 3,894,673 and 4,018,576 issued Jul. 15, 1975 and Apr. 9, 1997 respectively, both of which are incorporated by reference herein.

The braze bonded abrasive layer may include cutout or recessed portions such as at 28, which are not coated with abrasives and serve to provide space for the exit of swarf and fluids during the CMP polishing and conditioning process.

Figure 4:
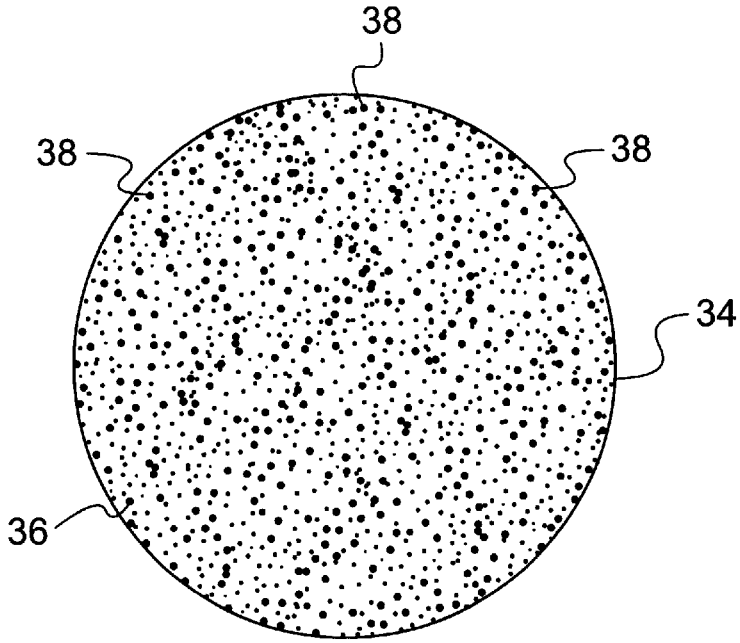
FIG. 4 is a top plane view of another pad polishing disk conformation typically employed in CMP processes.
Figure 5:
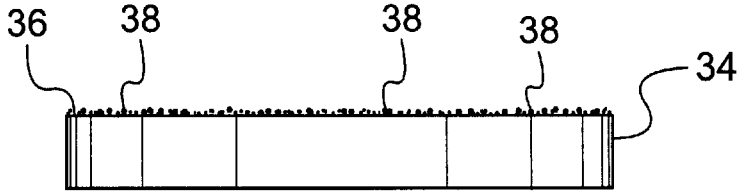
FIG. 5 is a side view of the disk shown in FIG. 4.

The form of the conditioning disk 20 shown may be usefully employed in well-known CMP polishing apparatus and methods such as described in the several of the prior patents cited earlier herein. However, other conventional designs of such conditioning disks useful in various forms of other conventional CMP polishing apparatus may also be employed using the present invention since the present invention relates to a braze bonded abrasive particle layer irrespective of the particulars of the general shape or form of the conditioning disk substrate employed with a given apparatus to condition a CMP polishing pad. One such form is shown in FIGS. 4 and 5 wherein a generally flat disk 34 having a selected thickness has one major surface 36 carrying a monolayer of braze bonded superabrasive particles 38 covering substantially the whole surface. The monolayer of abrasive particles may also take the form of other patterns on the surface, wherein some surface portions do not carry abrasive particles, as may be deemed desirable by the user without departing from the spirit of the present invention.

As best seen in the diagrammatic views of FIGS. 1 and 3, the superabrasive particles, such as 26, are strongly bonded to the bottom edge 24 of flange 22 by a metal braze 30 which preferably engages about 25 to 50 percent of the crystal surface with a meniscus of the braze defining a dip or valley between crystals. The particle size of the abrasive particles may be typically between about 50 to 200 U.S. mesh or any other size which may be deemed appropriate for a given CMP application. As earlier noted herein, this general type of braze bonding of the crystals to the substrate for CMP polishing pad conditioning has been demonstrated to provide significantly improved results compared to other methods of attaching or bonding the abrasive particles to the conditioning disk. Such improvements relate not only to increased useful life, as compared to electroplated or resin bonded types, but importantly lessen the risk of a premature bond failure causing loss of one or more diamond particles. The latter event may cause sufficient damage to the semiconductor wafer during the polishing process to render it a total loss. Since partially completed semiconductor wafers of this kind may represent a value of several thousand dollars, such an event can be seen as extremely undesirable.

However, even though the braze bonded version of conditioning disks for CMP polishing pads represent a very significant improvement in this regard, the corrosive nature of the conventional slurry solutions used in CMP processes does attack the braze bond which increases the potential for premature loss of abrasive particles. The current state of the art slurry compositions most often employed include either a base or acid composition and may vary in aggressiveness in degrading the bond between the abrasive particles and the substrate.

In another aspect, those skilled in the CMP art are developing other slurry compositions to improve given polishing pad applications, however, if the pad conditioners available cannot tolerate the corrosive effect of such compositions upon the bond between the abrasive particles and substrate, the corrosive attack represents a significant limit to using slurry compositions which otherwise may be deemed to improve the CMP process.

Presently, one of the more highly corrosive CMP abrasive slurry compositions used is a highly acidic mixture comprising ferric nitrate and an aluminum oxide abrasive. This type of slurry is commonly used for CMP polishing of tungsten and other metal deposits on silicon semiconductor wafers. Other slurry compositions are well known in the art such as those disclosed in U.S. Pat. No. 5,897,375 issued on Apr. 27, 1999 to Watts et al, U.S. Pat. No. 5,954,975 issued on Sep. 21, 1999 to Cadien and U.S. Pat. No. 5,916,855 issued on Jun. 29, 1999 to Avanzino.

In order to overcome or at least lessen the vulnerability to bond degradation due to the corrosive environment of these CMP polishing slurries, a protective coating 32 is applied over the braze bond in a manner which resists the corrosive effects to the bond material. The protective coating should be applied in a manner which maintains the essential contour designed into the diamond abrasive surface such that proper conditioning of the polishing pad may be accomplished and the coating process used must be economically practical relative to the overall cost of the pad conditioning disk.

Nickel-phosphorous coatings applied to a braze bonded conditioning disk, such as described in the examples herein, using electroless plating techniques to deposit a thickness between 0.0002 and 0.0005 inches showed essentially no improvement over a non-coated disk.

Coatings such as amorphous diamond sold under the trademark TETRABOND by Multi-Arc, Inc. located in Duncan, S.C., chromium, chromium nitride, Teflon® and multilayer versions of these materials showed positive results in resisting corrosive degradation of the braze bond material by acidic pad polishing slurry compositions.

Other coating materials which would be expected to be useful for the present invention include high chromium stainless steel alloys and ceramic coatings applied by physical vapor deposition including aluminum oxide, silicon oxide, cermet coatings (metal-oxide mixtures), and layered structures such as chromium and aluminum oxide, for example.

The thickness of the coating applied should be as low as possible to minimize distortion of the designed contour of the abrasive layer on the conditioning disk as well as to minimize the manufacturing cost factor. Coatings in the range of between about 1 to 20 microns are preferred. Coatings about 2 to 10 microns thick are more preferred. A range of 1.5 to 5 microns is most preferred and have been shown to work well with the coating materials tested as described more fully later herein. The coating applied should be relatively dense and exhibit a high degree of impermeability to liquids to limit contact of the liquid portion of the CMP slurry with the underlying braze bond material. Further, it is desirable to control the deposition of the layer of the coating material to obtain a high degree of uniformity.

Samples using uncoated braze bonded CMP conditioning disks such as manufactured and sold by Abrasive Technology, Inc. of Lewis Center, Ohio were used as controls and similarly manufactured disks were coated with various materials for testing as described in the following examples. The Teflon® coating was outsourced and applied by DURASHIELD-A Bundy Company located in Sunbury, Ohio using their proprietary processes. The chromium nitride/chromium multilayer, and chromium/amorphous diamond coatings were outsourced and applied by Multi-Arc, Inc. of Duncan, S.C. for the examples described herein.

The chromium coating described in Examples V and VI were applied by Abrasive Technology, Inc. located in Lewis Center, Ohio. The chromium coating multilayers in Examples II and III were applied by Multi-Arc, Inc. mentioned earlier herein.

EXAMPLE I

Nickel-Phosphorus Coatings

Two levels of phosphorus content were explored, medium (7–9%) and high (14%) using conventional electroless plating techniques to deposit the nickel-phosphorus coatings. A thickness range for the nickel-phosphorus coating was from 0.0002 to 0.0005 inches on the tested CMP discs.

EXAMPLE II

Amorphous Diamond/ Chromium Multilayer

The multilayering of amorphous diamond, sold under the brand name "Tetrabond" and chromium was produced by an arc physical vapor deposition process. Total coating thickness for this film combination was about 4 micrometers. A layer of the amorphous diamond coating was the final layer deposited on all samples made. The amorphous diamond coating is available under the trade name/trademark "Tetrabond" from Multi-Arc, Inc. identified earlier herein.

EXAMPLE III

Chromium Nitride/Chromium

A multilayer combination of chromium nitride and chromium was formed using an arc physical vapor deposition process and applied to an uncoated CMP disk to provide a relatively uniform coating layer having an average thickness of about 4 microns. The chromium nitride layer was the final layer deposited.

EXAMPLE IV

Teflon® Coating

Teflon® coating was applied to CMP disks, using a powder heat fusion process with primers, to promote adhesion. The coating on the samples ranged in thickness from an average of 5 to an average of 15 microns.

EXAMPLE V

Chromium

Typical conditions for the deposition of a protective chromium layer include the use of an unbalanced linear magnetron source, a working gas such as argon but other gases such as xenon, neon, krypton and mixtures thereof can be used. Following placement of the CMP disc in a vessel capable of being evacuated to a reduced atmospheric pressure such as $1\times10^{-5}$ torr, the working gas is admitted to a pressure range between $5\times10^{-4}$ torr to $20\times10^{-3}$ torr. Electrical conditions (i.e. current and voltage) are established for the magnetron source that permits the gas to become ionized at a pressure of $5\times10^{-4}$ torr to $5\times10^{-3}$ torr. Depending on the deposition rate desired, power applied to the magnetron can range from 1000 watts to 30,000 watts. Typically the power level is in a range of 1000 to 10,000 watts.

Prior to depositing chromium on to the monolayer of brazed diamond particles on the CMP disk, the surface is prepared using ion etching techniques. Argon ions accelerated by the negative voltage applied to the CMP disk bombard the braze and diamond removing surface contaminants such as oxides and organic films. In addition to this cleaning affect, the CMP disk is heated by the process which helps reduce the stress levels in the depositing chromium.

During the chromium deposition step, the negative voltage of 1000–2500 V used for cleaning is maintained to keep the surface clean to improve adhesion between the chromium film and the braze material and diamond particle layer and to control the structure of the chromium layer being deposited to eliminate columnar growth, and achieve a dense coating to reduce porosity. The high voltage (1000–2500 V) also provides a reaction at the surface of the braze bond material with the depositing chromium to form a strong interfacial bond between the chromium layer and braze bond material. Following the formation of a graded zone of braze material and the deposited chromium, the voltage is reduced to less than 1000 volts, typically 500 volts or less, to maintain a non-columnar, virtually non porous, low stress chromium coating. The chromium thickness may be applied in the range of about 1 to 20 microns with between about 2 to 10 microns being preferred. Braze bonded CMP conditioning disks as earlier described herein, were prepared with a protective chromium layer using the following steps:

1. Pump down the coating chamber first to $2\times10^{-5}$ torr.
2. Pre-clean step A Backfill chamber to $6.5\times10^{-3}$ torr with high purity argon gas.

Apply negative voltage to CMP disks in the range 400 volts, 0.5 amp for 30 minutes.
3. Pump down the chamber again to $1.7\times10^{-5}$ torr.
4. Pre-clean step B Backfill chamber to $6.5\times10^{-3}$ torr with argon gas.

Apply negative voltage to CMP in the range of −600 volts, 0.3 amp for 2 hours.
5. Coating step Reduce the pressure in step #4 to $9\times10^{-4}$ torr with argon.

Reduce the negative voltage on CMP to 100 volts at 0.58 amps.

Apply 4 Kw power to the chrome source for 35 minutes to achieve disposition rate of 0.40 microns/mins. The typical coating thickness applied on the samples made was about 14.0 microns.

EXAMPLE VI

Chromium Protective Coating

Another chromium coated CMP disk was prepared according to the following steps:

1. Pump down the coating chamber first to $2\times10^{-5}$ torr.
2. Preclean step Backfill chamber to $30\times10^{-3}$ torr with Argon 99.995%

Apply negative voltage to CMP disk in range of 1500 to 2500 volts at 0.017 amp/$_{in}^2$ for 30 minutes 3. Coating Step Reduce the Argon pressure to $5\times10^{-4}$ torr while maintaining the negative voltage in step 3 to the CMP disks.

Apply voltage to the unbalanced linear magnetron chromium (99.95%) sources to obtain 2 KW for each source.

Adjust the negative voltage on the CMP disks to 1000 volts and maintain power to the coating sources at 2 kW each. Hold this condition for 30 minutes.

Then reduce the negative voltage on the CMP disks to 500 volts while maintaining the 2 kW on the magnetron sources for 45 minutes at a deposition rate of 0.17 microns/minute. The coating thickness of the chromium layer deposited was about 2.5 microns.

Test Procedure

Static corrosion testing was conducted on coated and uncoated CMP disk samples made pursuant to Examples I through VI using the following test procedure.

All chemical immersion tests were performed with fresh ferric nitrate solutions (Ph 1.6).

A bond strength test (BST) was conducted and is a qualitative method to evaluate the mechanical bond strength of the braze to abrasive crystal and braze to the substrate, i.e., CMP disk. This test is performed by using an X-ACTO® X-3201 Standard Knife with an X-211 blade and manually applying a force of at least about 3 to 7 lbs. and preferably about 5 lbs. to the knife and blade held at a low angle in contact with the braze bonded diamond crystals layer. Such a knife is commercially available from Action Electronics, Inc. located in Santa Ana, Calif. The exact angle between knife blade and braze is not critical but should be less than 45 degrees. When the blade is forced against the braze bond of a CMP disk sample not exposed to corrosive slurry such as ferric nitrate, the knife blade often breaks at the tip with no effect on the bond. This indicates a high bond strength and good retention of the bond and abrasive particles on the disk.

However, when the same test was performed on an uncoated CMP disk exposed to the ferric nitrate slurry used in the tests described herein, it was relatively easy to remove both braze and diamond from the disk indicating a low bond strength, i.e., the braze bond strength has deteriorated significantly.

This comparative test procedure is a good indicator of the ability of the coating applied to the CMP disk to resist the corrosive effect of the CMP slurry composition, and a quantitative measure of the degree of protection provided to the underlying braze bond.

Each of the coated disks tested were compared with the bond strength test described performed on an uncoated CMP disk control prior to immersion in the ferric nitrate test solution.

Each of the coated disks made according to Examples I–VI and an uncoated CMP disk as a control were immersed for 25 hours in the ferric nitrate test solution and then visually examined at a 30×magnification for visual examination, each of the disks were subjected to the bond strength test described above to determine the mechanical strength of the braze bond.

The uncoated CMP disk control showed visual signs of corrosive attach, including a loss of 30 to 40% of bond height around the diamond particles in some locations and exhibited low bond strength as braze and diamond particles were relatively easily removed during the bond strength test indicating severe degradation of the braze bond.

The nickel-phosphorus coated disk tested similarly to the uncoated disk control, exhibiting significant degradation of the braze bond as braze bond and diamond particles were similarly easily removed.

The coated disks made pursuant to Examples II–VI each showed no discernable visual signs of corrosive attack after the 25 hour immersion tests and each exhibited a high bond strength during the bond strength testing which was essentially equivalent to an uncoated CMP disk control sample prior to immersion in the test solution. These test results show the coating applied resisted corrosive attack by the ferric nitrate test solution and protected the underlying braze bond.

In order to simulate field applications of CMP disk conditioners, an experimental dynamic test was established. A Buehler polisher was modified to be compatible with corrosive slurries such as ferric nitrate and other slurries for metal CMP needs. The CMP slurry used was a mixture of Cabot's W A400 sold by Cabot Corporation Microelectronics Materials Division located in Aurora, Ill. with a ferric nitrate solution having a pH between 1.0 to 2.0. Cabot's W A400 is a slurry including aluminum oxide abrasive particles.

CMP disks were mounted on a fixture such that the total weight equals approximately 9 pounds. A conventional CMP polishing pad, with concentric grooves, is mounted on the rotating platen of the polisher. The pad used is identified by the product number CRIC 1000-A3, 0.050 inches, GRV/V-5-IV and is commercially available from Rodel Products Corporation located in Scottsdale, Ariz.

In this dynamic testing, the pad and disk rotate in contact with each other lubricated by CMP slurry. The disk is forced against the pad with the force of nine (9) pounds. Rotation of the platen and disk is influenced by the disk rotation (40 to 45 rpm) which causes it to rotate. The platen rotates at approximately 18 to 25 rpm. Platen and conditioner rotate to the same direction.

The slurry mixture is transferred using a chemical resistant metering pump at a flow rate up to 200 ml/per minute. This rate is sufficient to maintain a suitable liquid concentration between the CMP disk and pad interface.

An uncoated CMP disk and the chromium-coated disk made pursuant to Example VI were subjected to dynamic testing pursuant to the test described above. Following 15 hours of dynamic testing in the same ferric nitrate—Cabot's W A400 slurry. An uncoated CMP disk had a visual appearance of corrosive attack. The color of the braze, normally a bright metallic gray with a slight luster, had changed to dark gray. Application of the bond strength test described herein reveals a low bond strength evidenced by removal of the braze bond and diamond crystals at the location of applying the knife blade.

Following 30 hours of dynamic testing in ferric nitrate—W A400 slurry, the chromium coated disk showed no significant change in visual appearance; i.e., the original bright metallic gray color was essentially unchanged.

Following the visual examination, the chromium coated disk was subjected to the bond strength test procedure and none of the braze bond or diamond crystals were removed. This indicated the initial braze bond strength was essentially unaffected. In view of these results, the coated disk would be expected to show similar results upon a longer exposure to these relatively severe conditions. This means that the chromium coating applied would protect the underlying braze bond such that the disk would remain useful for essentially the expected useful life of the diamond abrasive particles, that is, until the diamond particles eventually become worn down and dulled in the normal course of their useful abrasive life in the typical CMP conditioning process. The disclosed coating materials would be expected to exhibit some difference in degrees of corrosion protection depending on the chemical corrosive nature of the slurry used. Excellent protection is achieved through the use of coatings like chromium and combinations thereof in multilayers with amorphous diamond or diamond like carbon, and chromium nitride in the relatively harsh acidic slurries such as ferric nitrate. Such coatings would offer even greater protection to less harsh slurry compositions. Organic polymer coatings, such as Teflon® and polyurethane also show promise in this regard, however, this type of coating may tend to be more quickly worn away due to swarf abrasion than the metallic coatings.

Based upon the foregoing discussion and, examples, it should be understood that protective coatings of the nature described herein may be employed to improve the performance of braze bonded CMP conditioning disks. Such disks constructed in accordance with the present invention extend the useful life of the conditioning disk by resisting bond degradation due to the corrosive effects of the polishing slurries used and are likely to resist harsh CMP slurries which may be used in the future as compared to uncoated braze bonded disks. The reduction of the likelihood of premature loss of the superabrasive particles during the CMP process represents a very significant step forward in this art as used as providing an extended useful life to the pad conditioning disk, particularly in the highly corrosive slurry composition, such as ferric nitrate.

It is desirable to apply the protective coating in a manner to achieve as uniform a thickness as is practically feasible and the thickness stated herein for the coatings in the Examples are the approximate average thickness of the applied coatings. However, it should be understood by those skilled in the art that variations in thickness of the coating can be tolerated between the thinnest portion of a coating layer sufficient to provide the desired degree of protection and the thickest portion which is less than that which would distort the contour of the abrasive layer to a degree rendering the disk commercially ineffective.

What is claimed is:

1. A conditioning element useful for restoring a used CMP polishing pad to an operable condition comprising, in combination:

a generally disk shaped substrate having a monolayer of superabrasive particles braze bonded to a surface of said disk; and a protective coating layer resistant to chemical corrosion from an acidic or basic polishing slurry including at least one layer of chromium and at least one layer of amorphous diamond adhered in overlying relationship to said braze bond portion of said disk.

2. A conditioning element useful for restoring a used CMP polishing pad to an operable condition comprising, in combination:

a generally disk shaped substrate having a monolayer of superabrasive particles braze bonded to a surface of said disk; and a protective coating layer resistant to chemical corrosion from an acidic or basic polishing slurry including at least one layer of chromium and at least one layer of chromium nitride adhered in overlying relationship to said braze bond portion of said disk.

* * * * *